US009340266B2

(12) United States Patent
Kent

(10) Patent No.: US 9,340,266 B2
(45) **Date of Patent: *May 17, 2016**

(54) TACTICAL FLOTATION SAFETY SYSTEM

(71) Applicant: David G. Kent, Morehead City, NC (US)

(72) Inventor: David G. Kent, Morehead City, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/326,961

(22) Filed: Jul. 9, 2014

(65) Prior Publication Data

US 2014/0322999 A1 Oct. 30, 2014

Related U.S. Application Data

(63) Continuation of application No. 13/468,829, filed on May 10, 2012, now Pat. No. 8,808,048.

(60) Provisional application No. 61/484,394, filed on May 10, 2011.

(51) Int. Cl.
*B63C 9/125* (2006.01)
*F41H 1/02* (2006.01)

(52) U.S. Cl.
CPC ..... *B63C 9/1255* (2013.01); *F41H 1/02* (2013.01)

(58) Field of Classification Search
CPC ..... B63C 9/00; B63C 9/15; B63C 9/125; B63C 9/1255; B63C 9/155; F41H 1/00; F41H 1/02
USPC ..... 441/92, 106, 107, 108, 117, 119
See application file for complete search history.

(56) References Cited

U.S. PATENT DOCUMENTS

| | | | | |
|---|---|---|---|---|
| 5,456,623 | A | 10/1995 | Norris | |
| 5,996,115 | A | 12/1999 | Mazelsky | |
| 6,681,399 | B1 | 1/2004 | Kerr | |
| 7,261,608 | B2 | 8/2007 | Haddacks | |
| 7,335,078 | B2 | 2/2008 | Kent | |
| 7,917,967 | B2 | 4/2011 | Osborne | |
| 8,808,048 | B2 * | 8/2014 | Kent | 441/119 |
| 2013/0212764 | A1 | 8/2013 | Kent | |

* cited by examiner

*Primary Examiner* — Lars A Olson
(74) *Attorney, Agent, or Firm* — McLane Middleton, Professional Association

(57) ABSTRACT

A tactical flotation safety system having a tactical flotation safety vest attachment removably attached to a tactical vest. The tactical flotation safety vest attachment has two side panels adjustably attached at the back and which are secured at the front and back of the tactical vest with cover panels. The two side panels include inner flaps and outer flaps enclosing inflation bladders and inflation mechanisms. The inflation mechanisms are secured to the interiors of the side panels and connected to exterior handles. When necessary, a user may deploy the inflation bladders by pulling on the handles to activate a pressurized gas source, such as liquid carbon dioxide cartridges of the inflation mechanism thereby inflating the bladders to provide buoyancy to the user.

13 Claims, 12 Drawing Sheets

TACTICAL FLOTATION SAFETY SYSTEM

CROSS REFERENCE TO RELATED APPLICATION

This application is a continuation of U.S. application Ser. No. 13/468,829 filed May 10, 2012,which claims priority to U.S. Provisional Application Ser. No. 61/484,394 filed May 10, 2011. This application is also related to U.S. Provisional Application No. 61/599,711 filed Feb. 12, 2012. Each of the aforementioned applications is incorporated herein by reference in its entirety.

BACKGROUND

The present disclosure relates to an improved tactical flotation safety system having a flotation safety vest attachment and method for adapting a tactical vest for use as a flotation device. The flotation safety vest attachment disclosed herein may advantageously be used in conjunction with a military or tactical field vest. However, it will be recognized that the present tactical flotation safety system may be used to help users float when immersed in water under a variety of circumstances. Without limiting the foregoing, the present tactical flotation safety system may be adapted for attachment to a variety of articles worn by people, or, alternatively, may be adapted for use independently.

SUMMARY

A tactical vest to be worn about the torso region of a user includes a front panel, a rear panel, and first and second spaced apart shoulder straps. Each of the first and second shoulder straps secures an upper end of the front panel to an upper end of the rear panel. A first side panel extends between the front panel and the rear panel. A second side panel opposite the first side panel extends between the front panel and the rear panel. Each of said first and second side panels define a covering which houses an inflatable bladder when the bladder is in a deflated condition and a source of compressed gas coupled to the inflatable bladder. An actuator is coupled to each of the inflatable bladders for selectively inflating the inflatable bladders when necessary.

In one aspect of the present disclosure, a tactical flotation safety vest system for enabling its wearer to float when submerged in water is provided.

In a more limited aspect, a method for converting a tactical vest into a flotation safety system, e.g., for use as a life vest, using a military, law enforcement, or like tactical vest is provided.

One advantage of the present flotation safety vest attachment resides in its compatibility with existing tactical vests.

Another advantage of the present development is that the tactical flotation safety vest attachment is compact and may be deployed with very little effort on the part of the user.

Still further advantages will become apparent to those of ordinary skill in the art upon reading and understanding the detailed description of the preferred embodiments.

It is to be understood that both the foregoing general description and the following detailed description are exemplary and explanatory only and are not restrictive of the invention as claimed. The accompanying drawings, which are incorporated in and constitute a part of the specification, illustrate embodiments of the invention and, together with the general description, serve to explain the principles of the invention.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
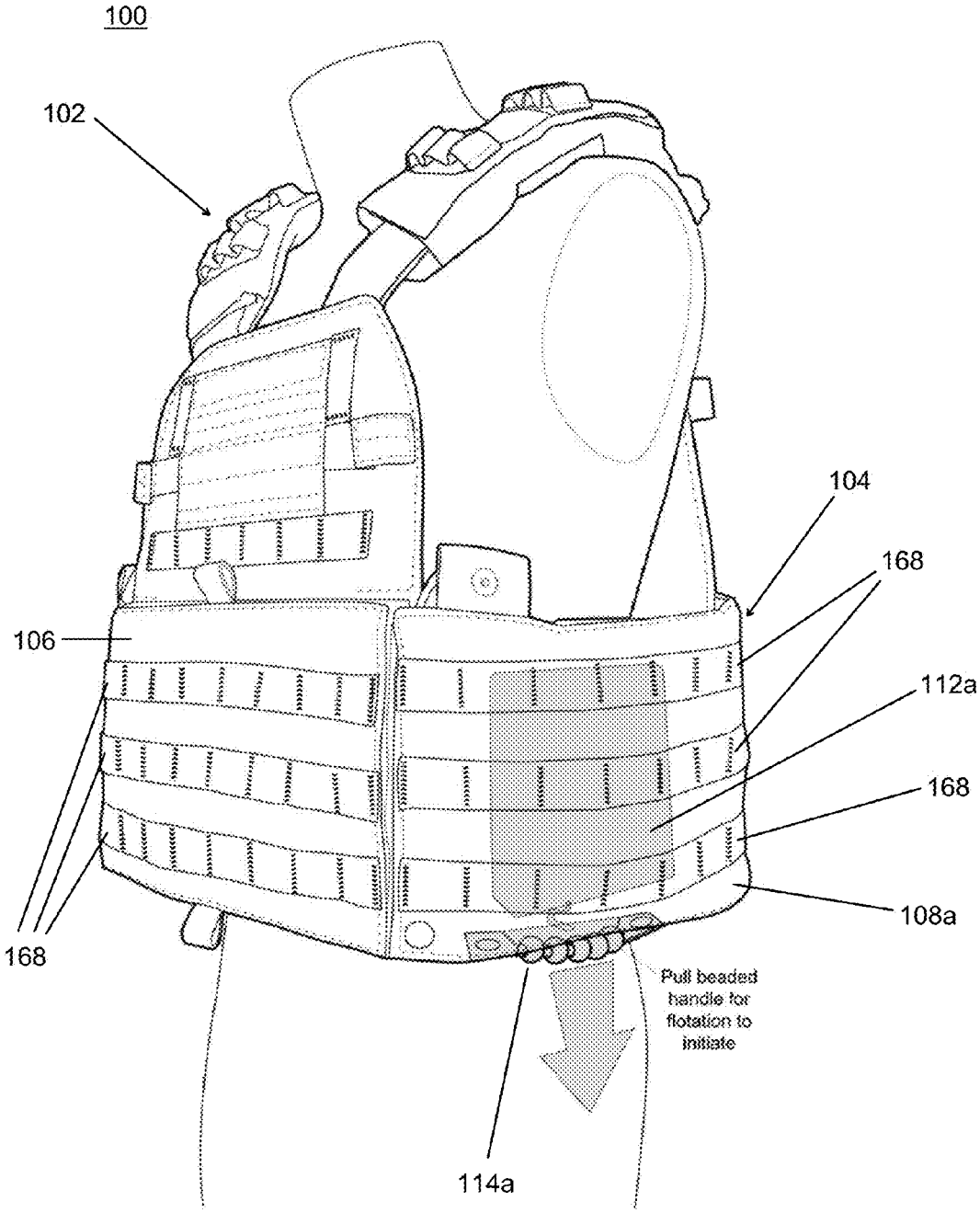
FIG. 1 is a perspective view of the tactical flotation vest attachment according to an exemplary embodiment of the present invention operably coupled to a tactical vest.
Figure 2:
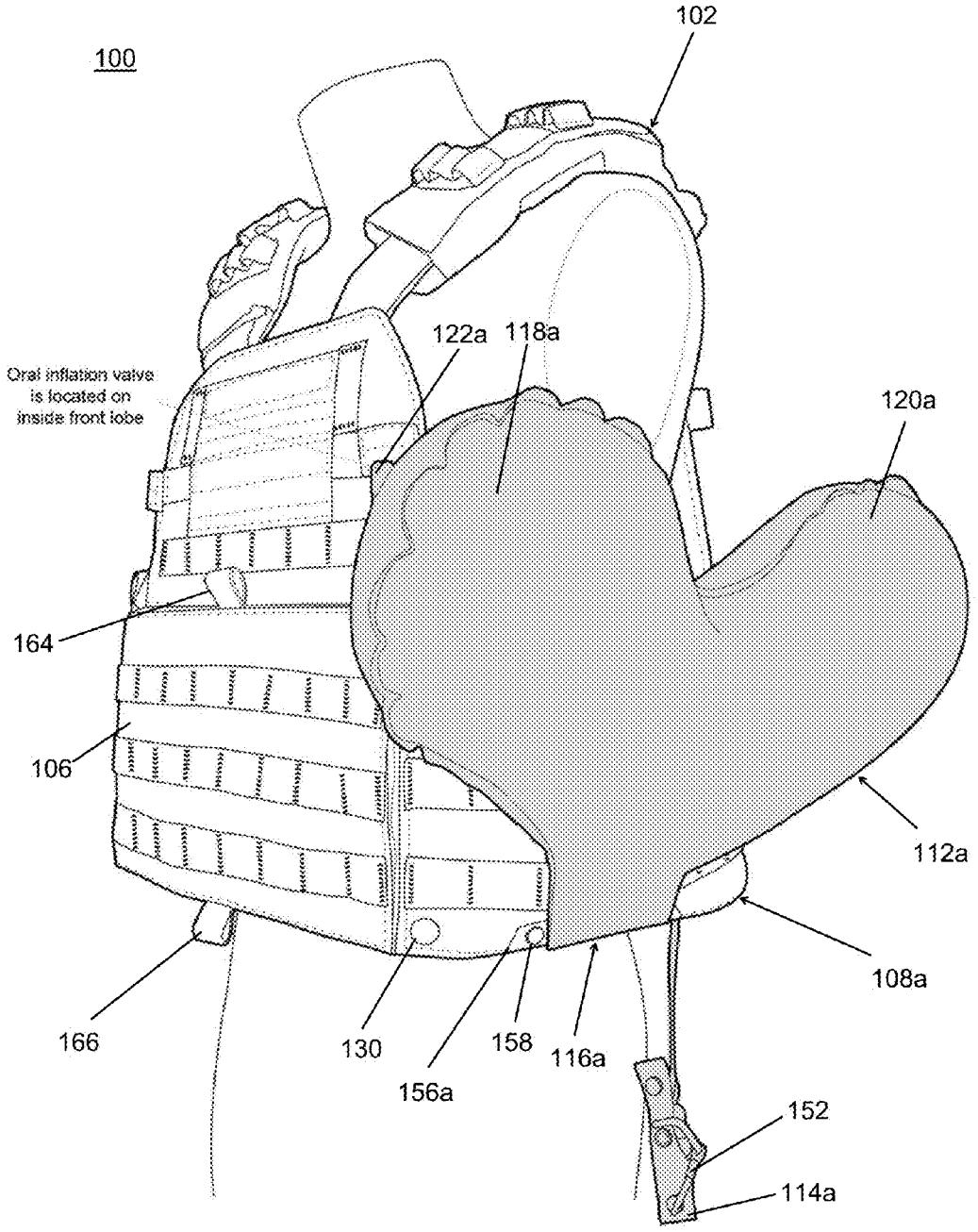
FIG. 2 is a perspective view of the tactical flotation vest attachment and tactical vest appearing in FIG. 1 with one of the inflatable bladders deployed.
Figure 3:
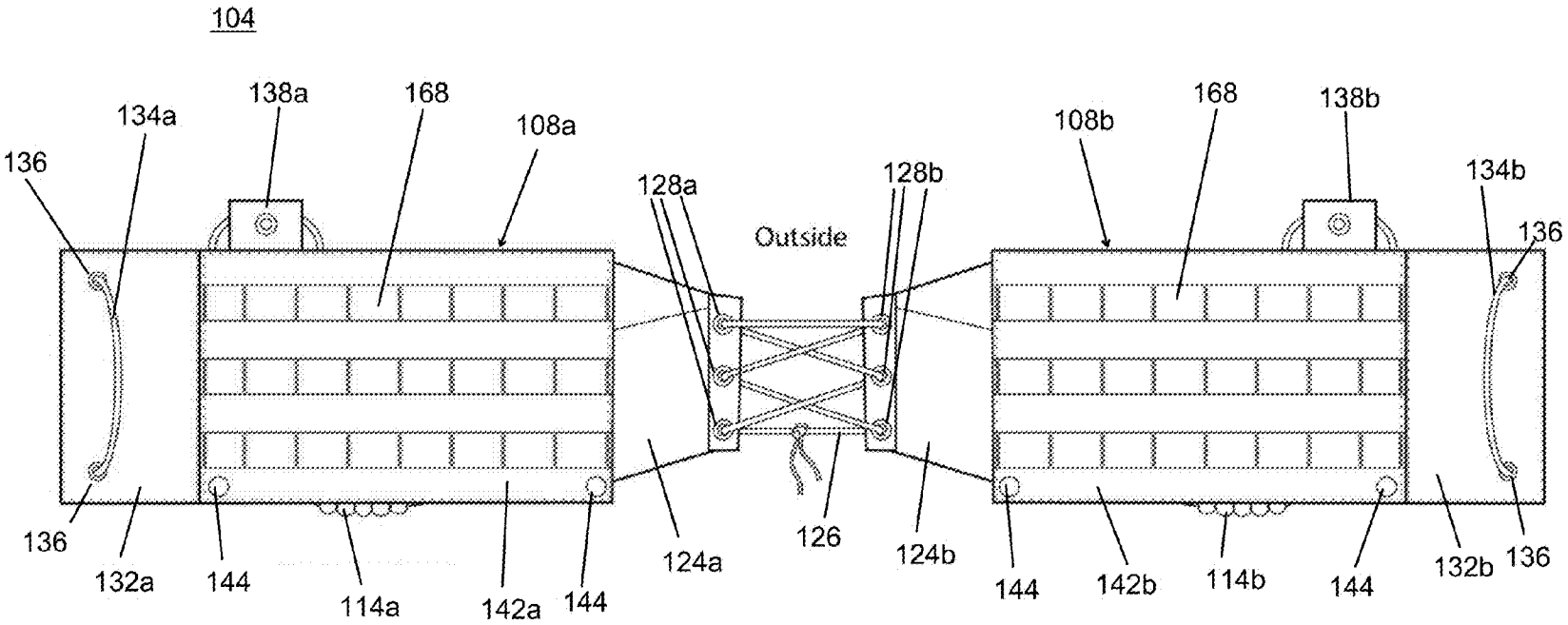
FIG. 3 is an elevational view of the outward facing side of the tactical flotation vest attachment.
Figure 4:
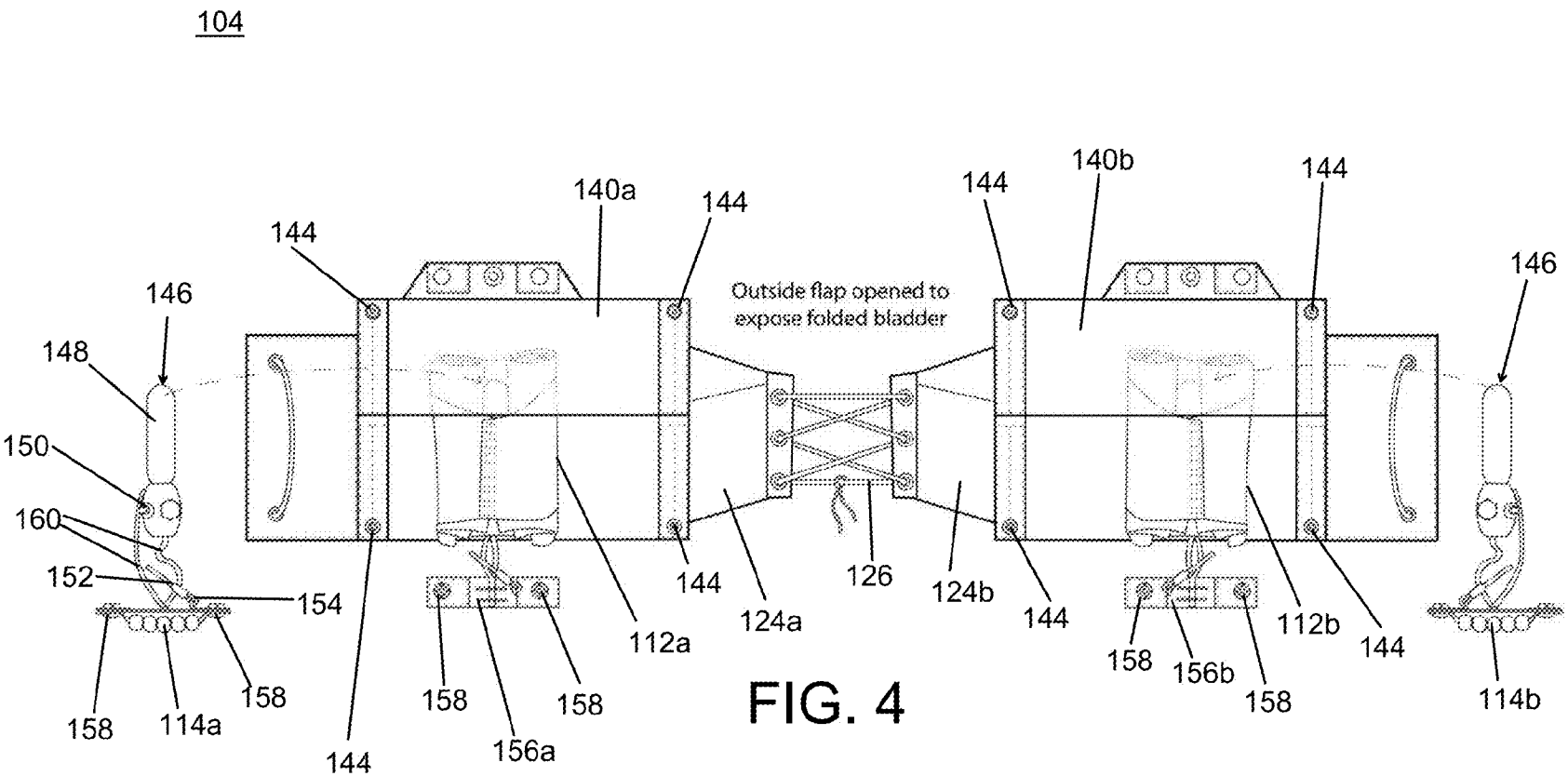
FIG. 4 is a partially exploded view of the tactical flotation vest attachment of FIG. 3, with the outside flaps opened to illustrate the bladders and the deployment mechanism.
Figure 5:
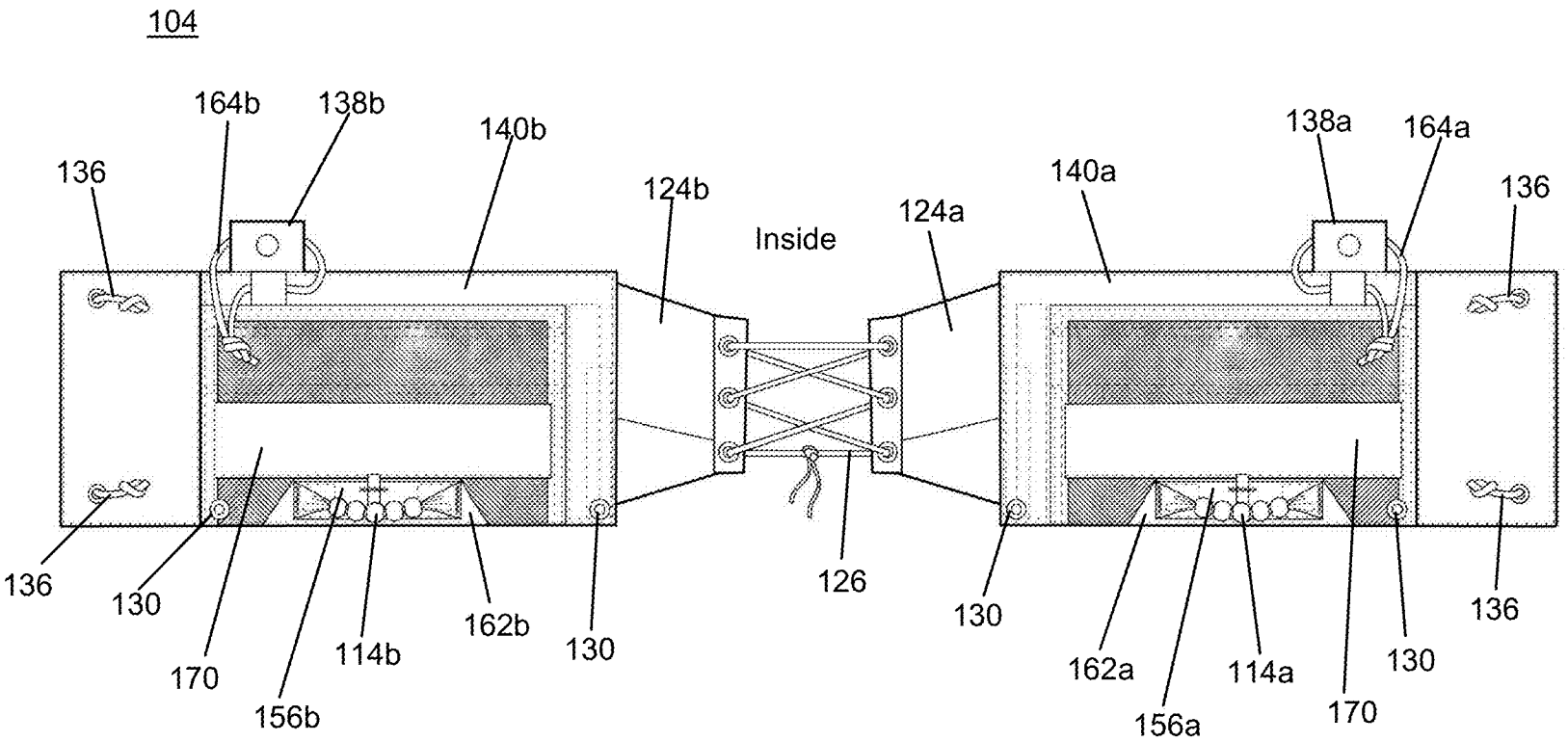
FIG. 5 is an elevational view of the tactical flotation vest attachment showing the inward facing side of the flotation vest attachment.
Figure 6:
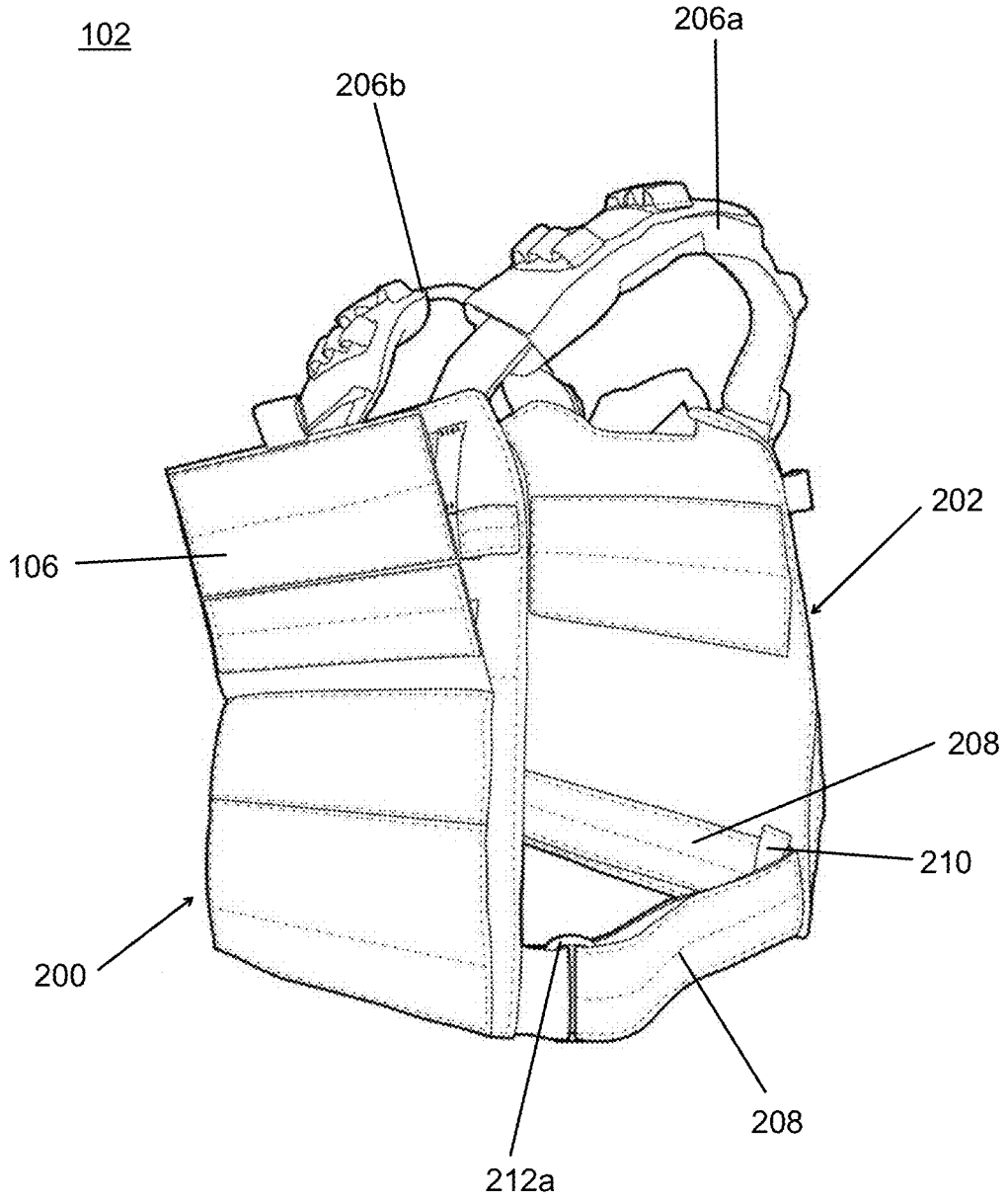
FIG. 6 is a perspective view of the tactical vest of FIG. 1 with the front flap in the open position.
Figure 7:
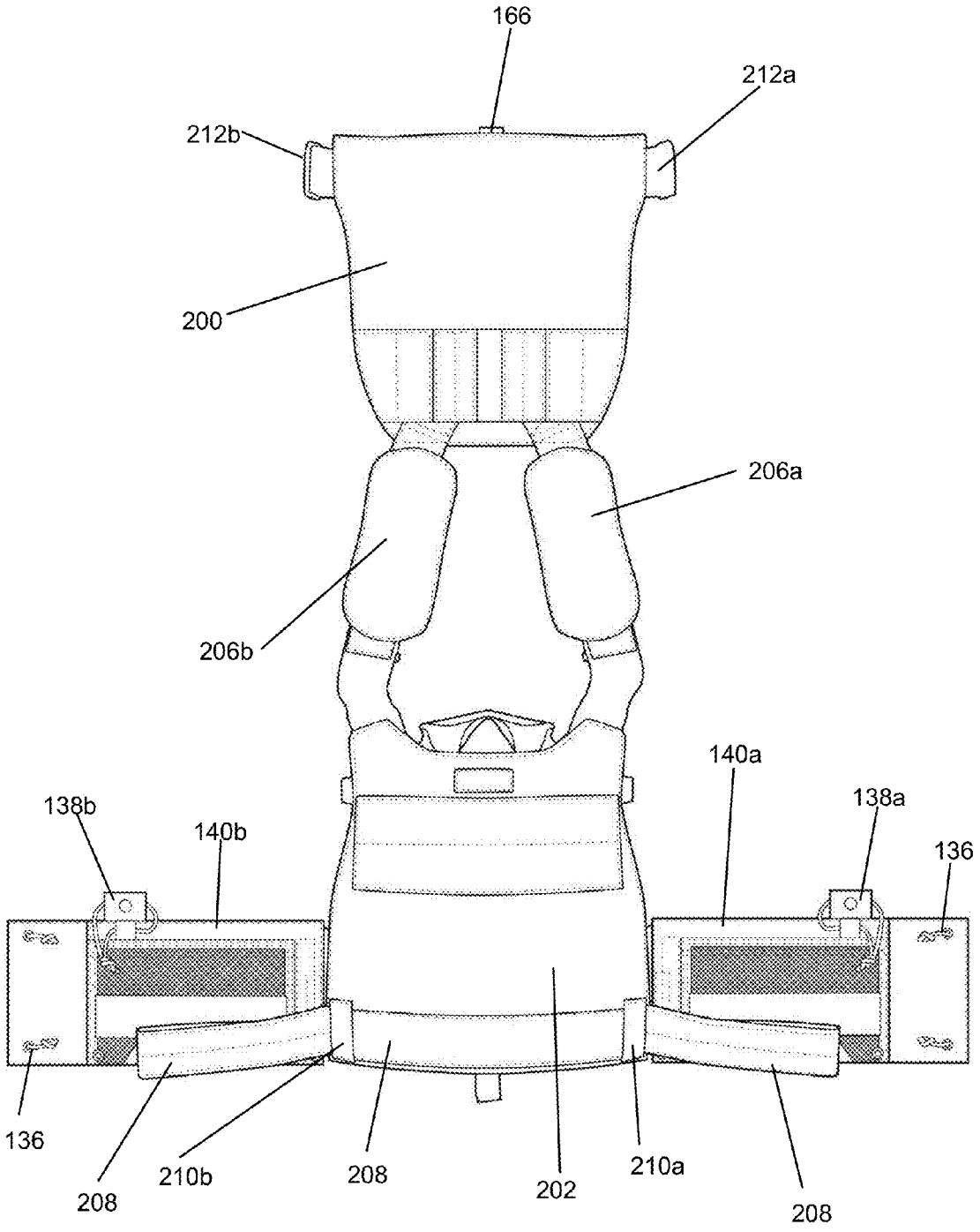
FIG. 7 is a plan view of the tactical vest of FIG. 6 having the front portion of the tactical vest in a flipped up potion and having the panels of the tactical flotation vest attachment attached to the rear portion of the tactical vest and showing the interior of the tactical vest and tactical flotation vest attachment.
Figure 8A:
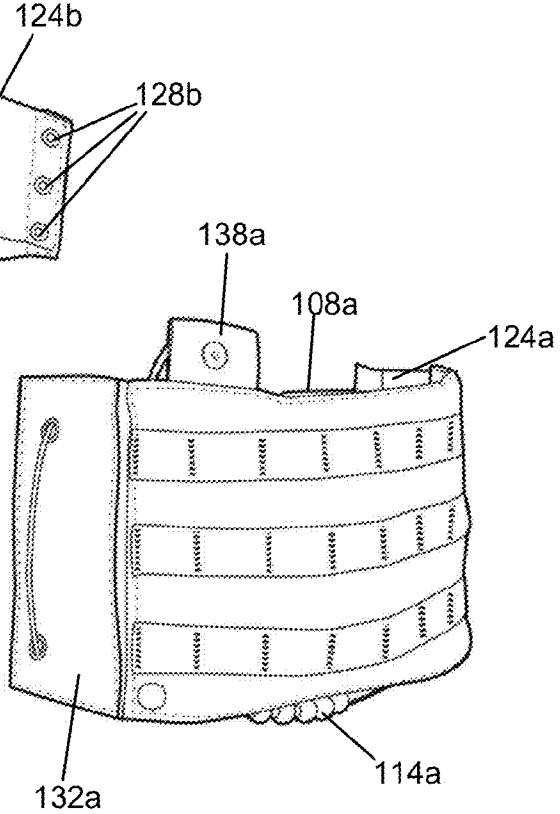
FIG. 8A is a perspective view of the left side tactical flotation vest attachment.
Figure 8B:
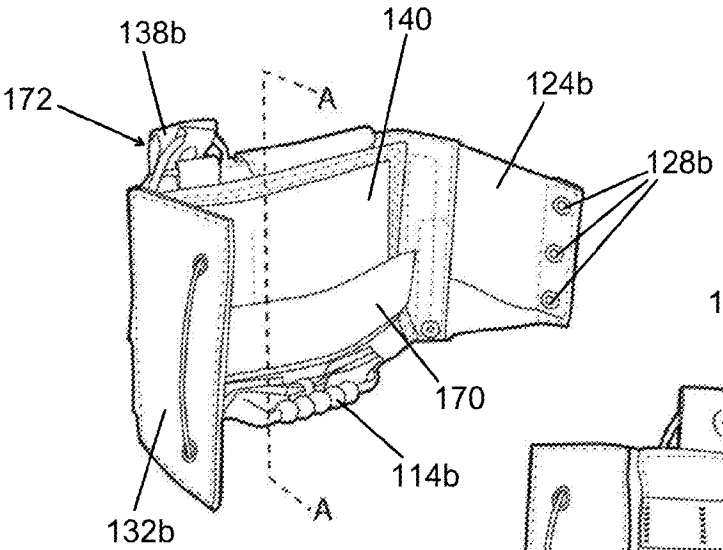
FIG. 8B is a perspective view of the interior of the right side tactical flotation vest attachment.
Figure 8C:
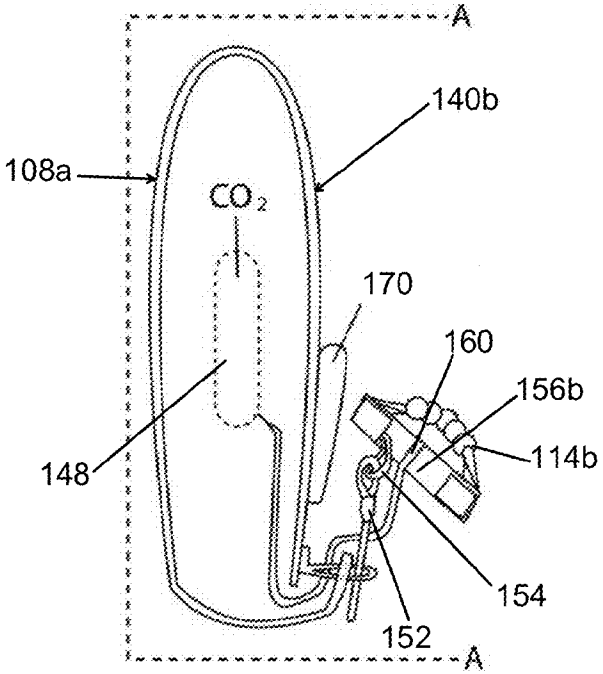
FIG. 8C is a cross-section view taken along the lines A-A of FIG. 8B.
Figure 9:
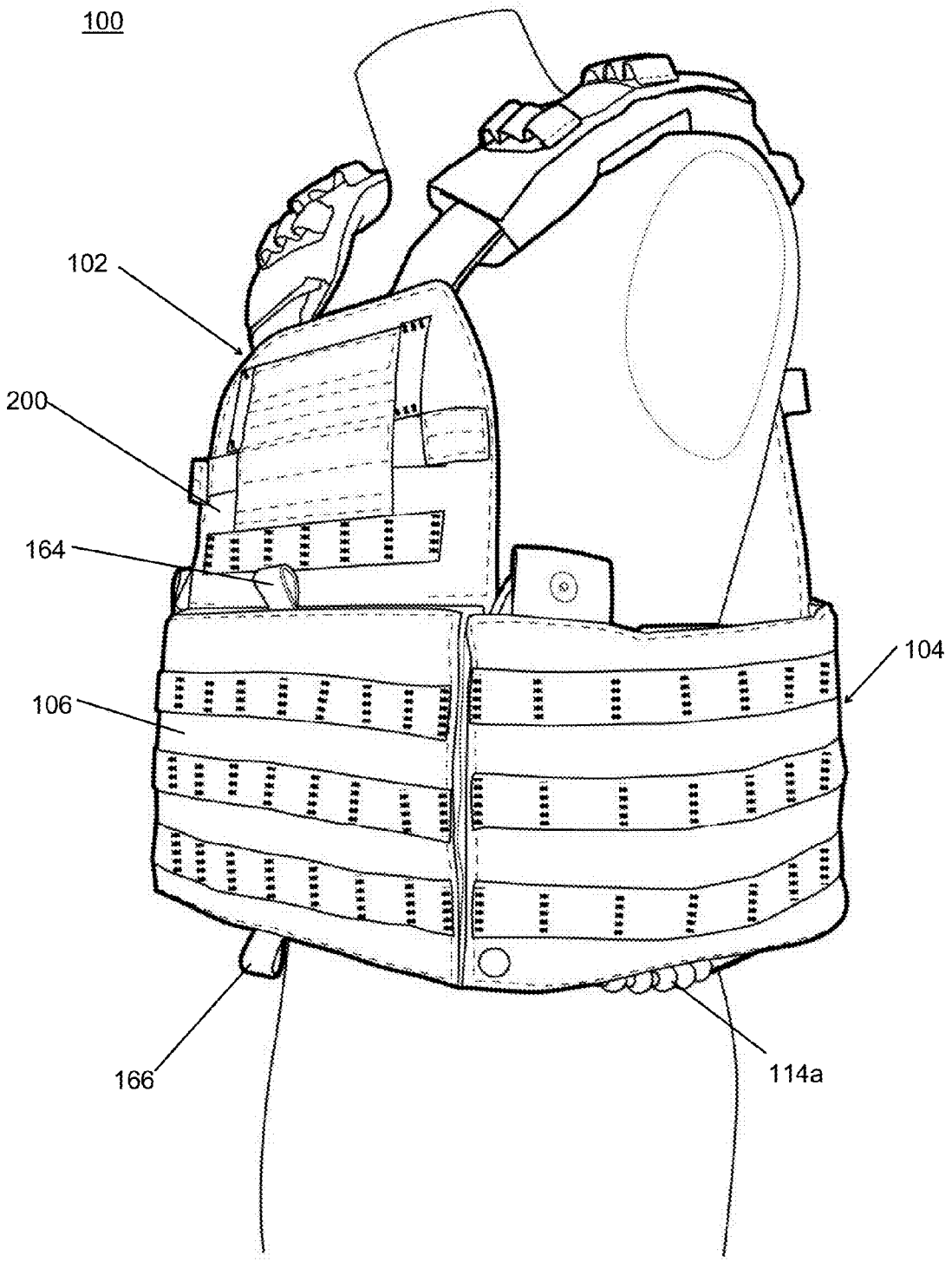
FIG. 9 is a perspective view of the tactical flotation vest attachment and tactical vest appearing in FIG. 1.
Figure 10:
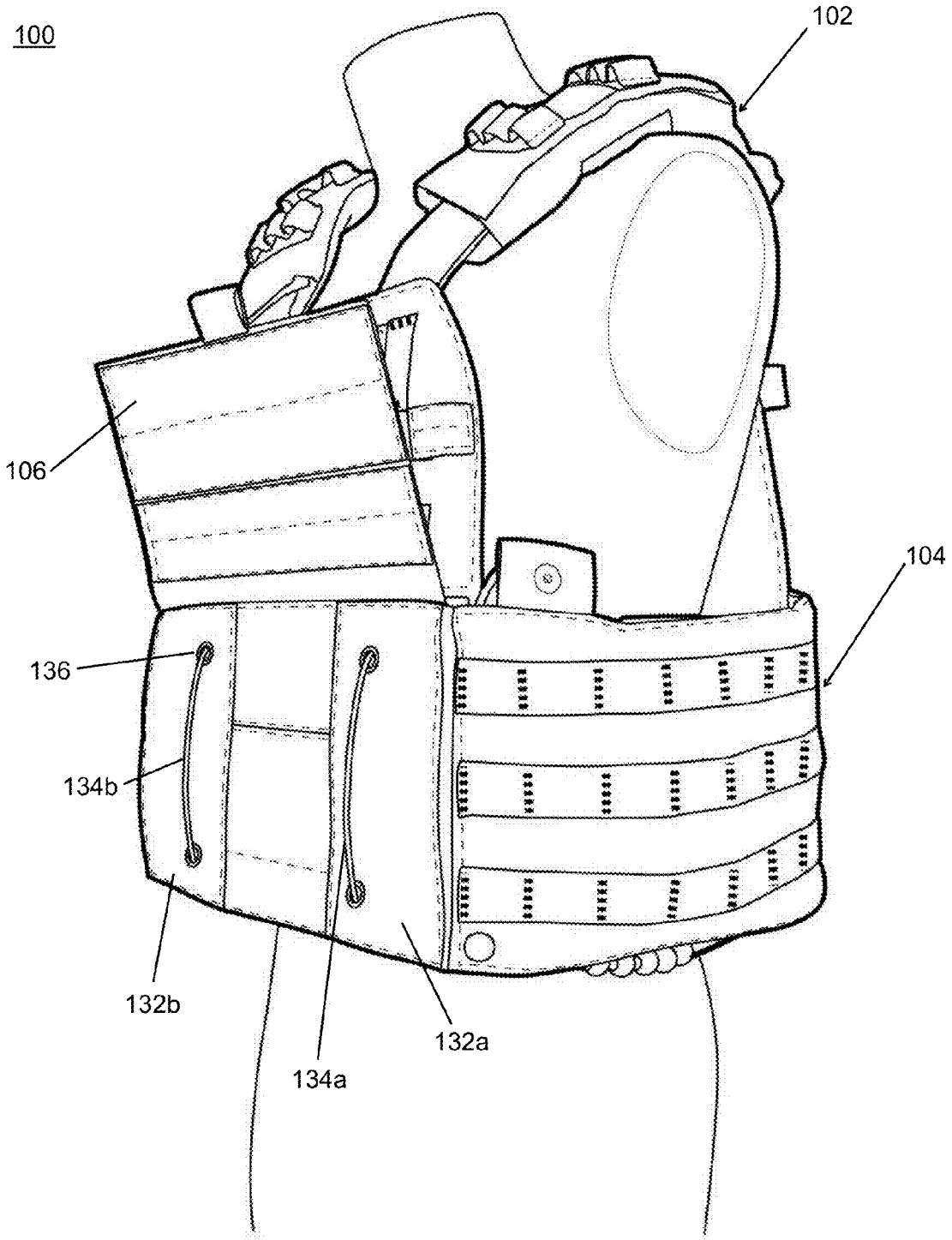
FIG. 10 is a perspective view of the tactical flotation vest attachment and tactical vest appearing in FIG. 1 with the front panel in the open position.
Figure 11:
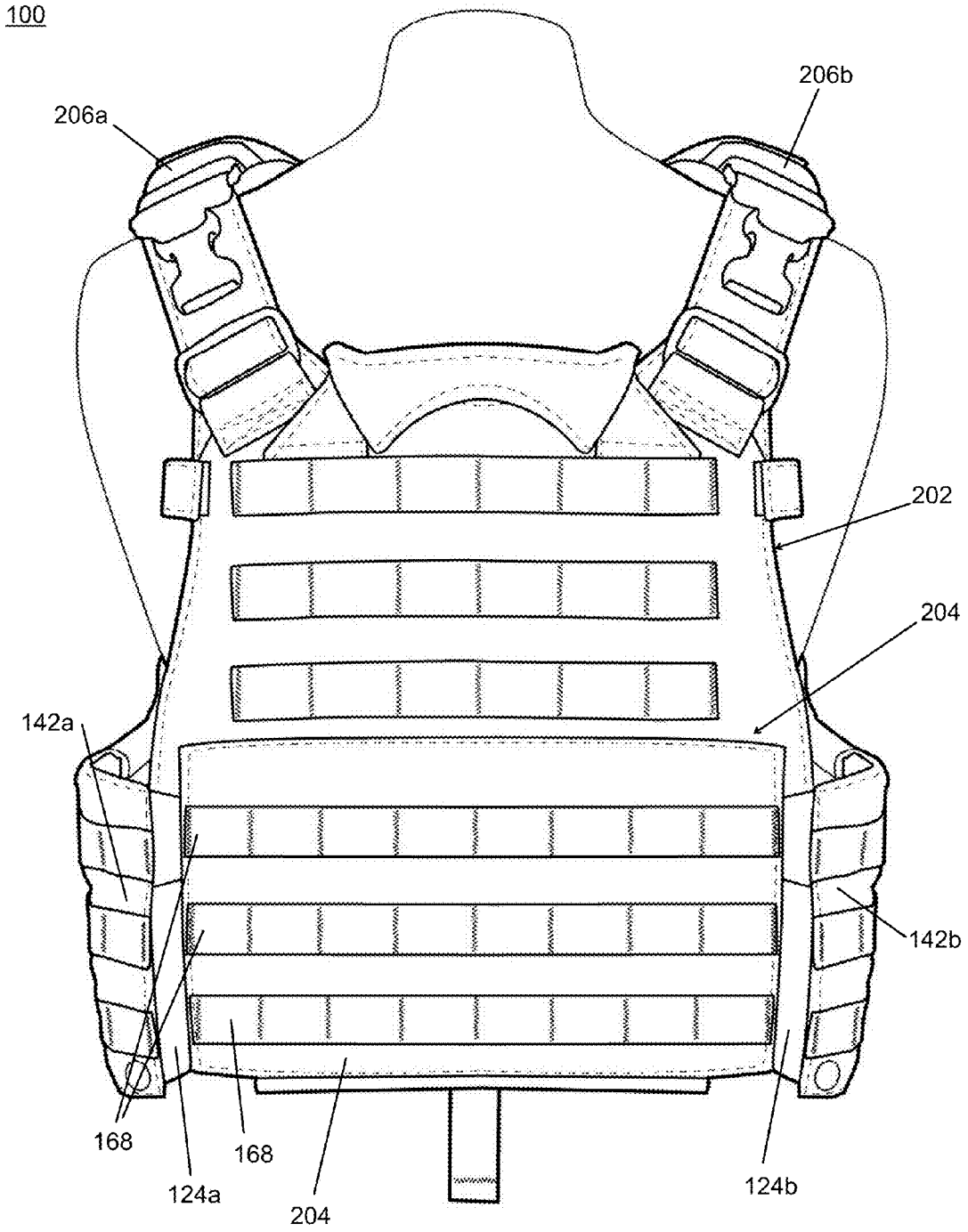
FIG. 11 is a rear view of the tactical flotation vest attachment according to an exemplary embodiment of the present invention operably coupled to a tactical vest.

Referring now to FIGS. 1-12, and with particular reference to FIGS. 1, 2, and 9-12, there appears an exemplary tactical flotation safety system 100 of the present invention. The tactical flotation safety system 100 includes a tactical vest 102 and an inflatable flotation vest attachment 104. The flotation vest attachment 104 has a left side panel 108*a* and a right side panel 108*b*. As best seen in FIGS. 6 and 7, the tactical vest 102 includes a front side 200 having a front panel 106, a back side 202 having a rear panel 204, two straps 206*a* and 206*b* connecting the front side 200 to the back side 202 at the user's shoulders, and a belt 208 for securing the front side 200 and back side 202 together at the user's waist. In the exemplary depicted embodiment the belt 208 passes through loops 210*a* and 210*b* on the inside of rear panel 204 and through the buckles 212*a* and 212*b*, respectively, on the front side 200 of the tactical vest 102. The front and rear panels of the tactical vest may include a ballistic-resistant material, such as a hard or soft ballistic panel or plate.

The front panel 106, rear panel 204, and side panels 108*a*, 108*b* may each have a one or more rows of webbing 168, such as nylon webbing. In the exemplary depicted embodiment there are three rows of webbing per panel, e.g., attached at each end and at spaced apart intervals, e.g., at 1.5 inch intervals. The upper portion of the front side 200 and back side 202 of the tactical vest 102 may also have a plurality of rows of webbing 168. In the exemplary depicted embodiment there is one row of webbing on the front side 200 and three rows of webbing on the back side 202. The webbing 168 enables the user to attach various types of modular gear, pouches, body armor, holsters, etc., which they may need to the flotation vest 104 and the front panel 106. It will be recognized that other webbing configurations are possible. The webbing grid 168 may be formed of nylon and may conform to promulgated standards, such as the Pouch Attachment Ladder System (PALS) or the like.

As best seen in FIG. 2-5, each side panel 108*a* and 108*b* also has a pull handle 114*a* and 114*b*, respectively. The pull handles 114*a* and 114*b* each engage an inflation bladder 112*a* and 112*b*, respectively, located within the left and right side panels 108*a* and 108*b*. When pull handle 114*a* is tugged, the inflation bladder 112*a* is released through an opening 116*a* and inflates. Similarly, when pull handle 114*b* is tugged, the inflation bladder 112*b* releases through a like opening, not shown, on the user's right side and inflates. If the inflation bladder 112*a* fails to inflate the user may manually inflate the inflation bladder 112*a* using an oral inflation valve 122*a* located on the bladder 112*a*. Likewise, if the inflation bladder 112*b* fails to inflate the user may also manually inflate the inflation bladder 112*b* using an oral inflation valve. In the depicted preferred embodiment, the oral inflation valve is located on the front lobe so as to be positioned near the user's mouth.

Figure 12:
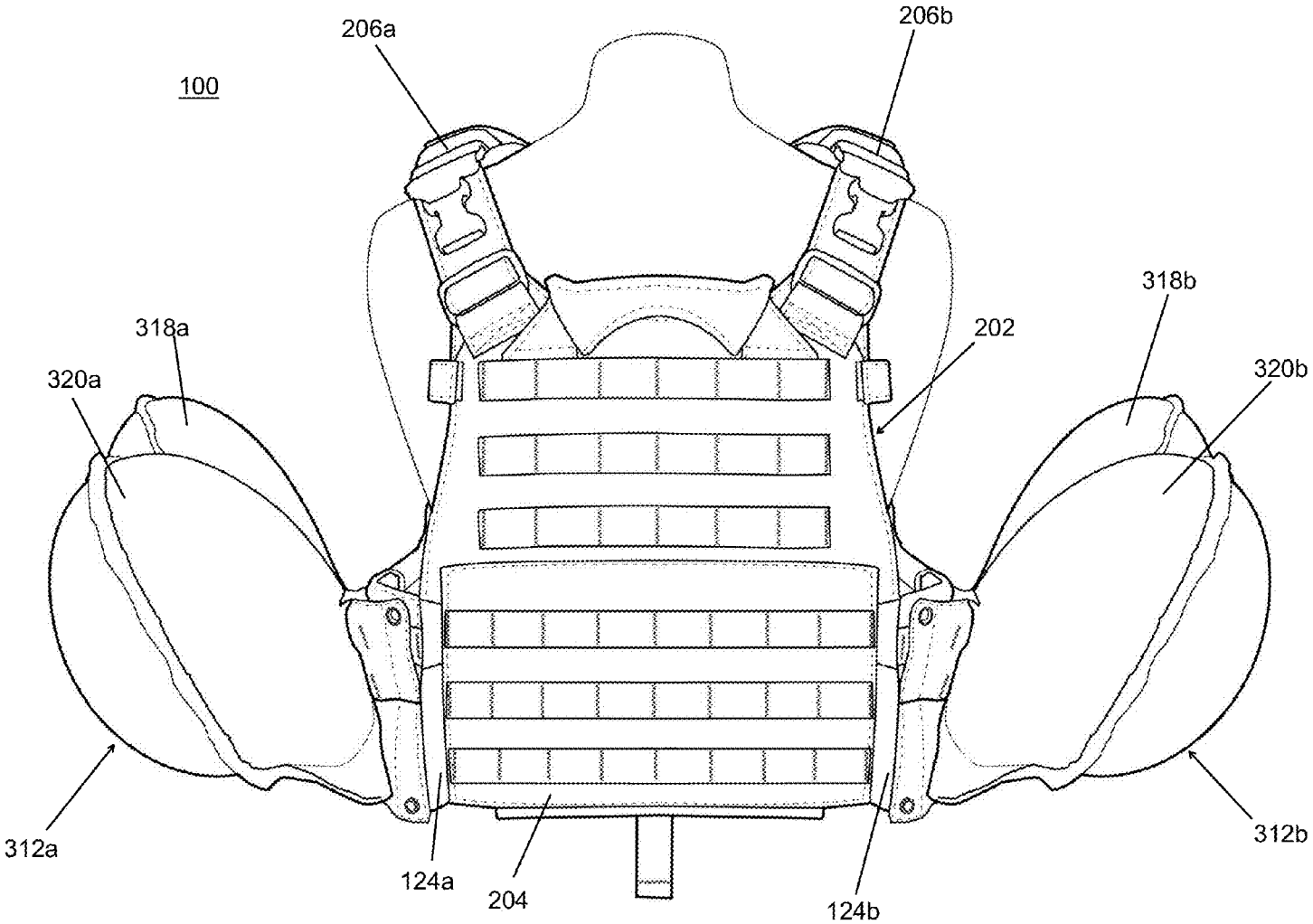
FIG. 12 is a rear view of an alternative embodiment of the tactical flotation vest attachment and tactical vest appearing in FIG. 1 with both of the inflatable bladders deployed.

In an alternative embodiment as best seen in FIG. 12, when pull handle 114*a* is tugged, the inflation bladder 312*a* is released thereby forcing the closures 144 to disengage and the outer flap 142*a* to open and fold back onto itself as inflation bladder 312*a* inflates. Similarly, when pull handle 114*b* is tugged, the inflation bladder 312*b* releases thereby forcing the closures 144 to disengage and the outer flap 142*b* to open and fold back onto itself as inflation bladder 312*b* inflates.

In the depicted preferred embodiments, the bladders 112*a*, 112*b* are generally heart-shaped including a front lobe 118*a* and rear lobe 120*a*, not shown for bladder 112*b*, and the bladders 312*a*, 312*b* including a front lobe 318*a*, 318*b* and rear lobe 320*a*,320*b*, thereby defining a space for the user's arms to extend between the front and rear lobes when the bladders are inflated. In certain embodiments, the bladder may be as described in my U.S. Pat. No. 7, 335, 078 issued Feb. 26, 2008, entitled "Tactical Flotation Support System," which is incorporated herein by reference in its entirety.

As best seen in FIGS. 3-5 and 8A-8C, and with continued reference to FIGS. 1, 2, 6, 7, and 9-12, the flotation vest attachment 104 has a left side panel 108*a* and a right side panel 108*b*, which in turn have a rear tab 124*a* and a rear tab 124*b*, respectively. The side panels 108*a* and 108*b* are secured together at the rear tabs 124*a* and 124*b*. In the preferred embodiment, the side panels 108*a* and 108*b* are attached using an adjustable corset type closure, although other closure means including hook and loop fasteners, straps, buckles, and the like are also contemplated. The adjustable corset closure has a string 126 which is alternately laced through a plurality of openings or eyelets 128*a* and 128*b* on the rear tabs 124*a* and 124*b*. In the depicted embodiment, each rear tab 124*a* and 124*b* has three eyelets 128*a* and 128*b*. The adjustable closure enables users to make the flotation vest attachment 104 larger or smaller based on the size of their body.

In use, the flotation vest attachment 104 wraps around the lower portion of the tactical vest 102 at the waist of the user. The rear tabs 124*a* and 124*b* of the flotation vest attachment 104 align with the lower back of the user and are secured to the tactical vest 102 using rear panel 204. The side panels 108*a* and 108*b* of the flotation vest attachment 104 cover the user's sides. Advantageously, the rear tabs 124*a* and 124*b* are adapted to secure to the existing, complimentary rear panel 204, allowing the flotation vest attachment 104 to be retrofit to existing vests 102. However, it will be recognized that other types of fasteners could also be used, including buttons, hook and loop fasteners, zippers, ties, hooks, buckles, snap lock type fasteners, or the like. The side panels 108*a* and 108*b* of the flotation vest attachment 104 also include a left front tab 132*a* and a right front tab 132*b* which align generally with the abdominal region of the user. Advantageously, the front tabs 132*a* and 132*b* are adapted to secure to the existing, complimentary front panel 106, allowing the flotation vest attachment 104 to be retrofit to existing vests 102. Each front tab 132*a* and 132*b* has a cord 134*a* and 134*b* which attaches to the respective front tab 132*a* or 132*b* through openings 136. The cords 134*a* and 134*b* may be used for easy removal of the front tabs 132*a* and 132*b* from the front side 200 of the tactical vest 102. The tabs 164 and 166 are also provided to aid a user in quick and easy removal of the flotation vest attachment 104 from the tactical vest 102 when necessary.

The flotation vest attachment 104 may include a radio pouch 172. The radio pouch 172 having a closure 138*a*138*b* with a snap 174 for securing the radio within the flotation vest attachment. The radio pouch 172 may also have an optional lanyard 164*a*164*b* which may be secured to a radio via an optional lanyard interface on the radio, not shown. While the lanyard and lanyard interface are optional, the use of a lanyard maybe advantageous in preventing damage to the radio, not shown, in the event it comes out of the radio pouch 172 or is dropped by the user.

As best seen in FIGS. 3, 4 and 8A-8C, and with continued reference to FIGS. 1, 2, 5-7, and 9-12, the side panels 108*a* and 108*b* each have an inner flap 140*a* and 140*b*, respectively, and an outer flap 142*a* and 142*b*, respectively. The outer flaps 142*a* and 142*b* are secured to the inner flaps 140*a* and 140*b* via closures 144, which may be of the snap fit type although other fasteners, including buttons, hook and loop, etc. are also contemplated. When the inflation bladders 112*a*, 112*b*, 312*a* and 312*b* are undeployed they are folded and secured between the inner flaps 140*a* and 140*b* and the outer flaps 142*a* and 142*b* of the side panels 108*a* and 108*b*. An inflation mechanism 146 is attached to the side panels 108*a* and 108*b* and sits within each of the folded inflation bladders 112*a*, 112*b*, 312*a* and 312*b* to provide the mechanism for inflating the bladders 112*a*, 112*b*, 312*a* and 312*b* when the handles 114*a* and 114*b* are pulled. The handles 114*a* and 114*b* each have a rear attachment portion 156*a* and 156*b* which secures the handles 114*a* and 114*b* to the inner flaps 140*a* and 140*b*, respectively, at attachment flaps 162*a* and 162*b* using closures 158.

Each inflation mechanism 146 has a pressurized gas (e.g., carbon dioxide) canister or cartridge 148. The outlet of the cartridge 148 is coupled to a valve 150. The valve 150 may be threaded valve for receiving an threaded end of a gas canister such as a $CO_2$ cartridge and a piercing pin mechanically coupled to the handle 114*a* or 114*b*. The valves 150 are also coupled to an inlet of the bladders 112*a*, 112*b*, 312*a* and 312*b* to enable the gas stored in the canisters 148 to fill the bladders

112*a*, 112*b*, 312*a* and 312*b* when the handles 114*a*, 114*b* are pulled. When a user pulls the handles 114*a*, 114*b*, the pins 152 which attach to the rear attachment portions 156*a*, 156*b* of the handles 114*a*, 114*b* at hooks 154 disengage the valve members 150, thereby opening the valves 150 and allowing the gas from the canisters 148 to inflate the bladders 112*a*, 112*b*, 312*a* and 312*b*. The rear attachment portions 156*a*, 156*b* of the handles 114*a*, 114*b* also connect to one or more cords 160 at a first end to prevent the handles 114*a*, 114*b* from being lost after they are pulled to deploy the bladders 112*a*, 112*b*, 312*a* and 312*b*. The cords 160 connect at a second end to the connection member 150 at one or more different points and the connection member 150 attaches to the inner flaps 140*a*, 140*b* of the side panels 108*a*, 108*b*. In the exemplary depicted embodiment of FIG. 4 there are two cords 160. In the alternative exemplary depicted embodiment of FIGS. 8A-8C there is one cord 160. A comfort pad or anti-chaffing pad 170 is attached to the inner flaps 140*a* and 140*b* providing a cushion between the inflation mechanism 146 and the users sides.

The flotation vest attachment 104 may also be equipped with an automatic inflation switch, not shown, which causes the inflation mechanism 146 to automatically activate and fill the bladders 112*a*, 112*b*, 312*a* and 312*b* when the automatic inflation switch is completely submerged in water. For example, the switch may comprise spaced apart electrodes or contacts which are triggered when water bridges the contacts, or any other electronic actuator which senses water. Advantageously, accidental or inadvertent inflation may be prevented by delaying the automatic inflation until the switch as been fully submerged in water for a prespecified period of time prior to activating the inflation mechanism 146, e.g., by providing an outer covering over the sensor which slows the rate at which water reaches the switch or sensor. The automatic inflation of the flotation vest attachment 104 enables the flotation vest attachment 104 to be inflated when the user is submerged in water and unable to manually activate the inflation of the bladders 112*a*, 112*b*, 312*a* and 312*b* using the handles 144*a* and 114*b*.

In alternative embodiments, auto-inflation may be provided using an auto actuator be of the type which uses a compressed member such as a spring which is actuated in the presence of water (e.g., by using a soluble bobbin or pill) which, in turn, drives a piercing member to pierce the cartridge and to allow the pressurized gas to enter the bladder chamber. In an especially preferred embodiment, delayed inflation may be provided by enclosing the soluble bobbin within a water resistant cover so as to slow or delay the entry of water. In this manner, environmental moisture such as rain, water spray, or the like will not cause inadvertent inflation of the bladder, but which will admit water to actuate the auto inflation in the event of submersion in water. The auto-actuator may be of the type commercially available from Halkey-Roberts and others.

The invention has been described with reference to the preferred embodiments. Modifications and alterations will occur to others upon a reading and understanding of the preceding detailed description. Therefore, it is not desired to limit the invention to the specific examples disclosed or the exact construction and operation shown and described. Rather, all suitable modifications and equivalents may be resorted to, falling within the scope of the invention.

What is claimed is:

1. A tactical vest to be worn about the torso region of a user, comprising:

a front panel;

a rear panel;

first and second spaced apart shoulder straps, each of said first and second spaced apart shoulder straps securing an upper end of the front panel to an upper end of the rear panel;

a first side panel extending between said front panel and said rear panel and covering a portion of a first side of the user's torso when the user is wearing said tactical vest;

a second side panel opposite the first side panel extending between said front panel and said rear panel and covering a portion of a second side of the user's torso when the user is wearing said tactical vest;

each of said first and second side panels defining a covering housing an inflatable bladder when the bladder is in a deflated condition and a source of compressed gas coupled to said inflatable bladder; and an actuator coupled to each of said inflatable bladders for selectively inflating said inflatable bladders.

2. The tactical vest of claim 1, further comprising:

said first side panel having a first tab for removably securing the first side panel to the front panel, wherein a first peripheral edge of the covering defined by the first side panel coincides with a peripheral edge of said front panel; and said second side panel having a second tab for removably securing the second side panel to the front panel, wherein a first peripheral edge of the covering defined by the second side panel coincides with a peripheral edge of said front panel.

3. The tactical vest of claim 2, further comprising:

said first side panel having a first rear tab for removably securing the first side panel to the rear panel, wherein a second peripheral edge of the covering defined by the first side panel coincides with a peripheral edge of said rear panel; and said second side panel having a second rear tab for removably securing the second side panel to the rear panel, wherein a second peripheral edge of the covering defined by the second side panel coincides with a peripheral edge of said rear panel.

4. The tactical vest of claim 3, further comprising:

a hinged flap attached to the front panel movable between an open position and a closed position, said hinged flap covering said first and second front tabs when the hinged flap is in the closed position.

5. The tactical vest of claim 1, wherein said source of compressed gas is a carbon dioxide cartridge.

6. The tactical vest of claim 1, wherein each of said first and second side panels includes a mechanical actuator for opening a valve to allow the compressed gas to enter said bladder.

7. The tactical vest of claim 1, further comprising:

an oral inflation valve for allowing a user to orally inflate said bladder during use.

8. The tactical vest of claim 1, wherein said actuator coupled to each of said inflatable bladders for selectively inflating said inflatable bladders includes a valve including a piercing pin for selectively providing a fluidic coupling between said bladder and said source of compressed gas.

9. The tactical vest of claim 1, wherein said actuator coupled to each of said inflatable bladders for selectively inflating said inflatable bladders includes a valve which includes a water soluble bobbin for automatically inflating the bladders when said actuator is submerged in water and the water soluble bobbin dissolves.

10. The tactical vest of claim 1, wherein said actuator coupled to each of said inflatable bladders for selectively inflating said inflatable bladders includes a valve which includes a water sensor for electronically detecting the presence of water.

11. The tactical vest of claim 10, wherein said water sensor is an electrical switch which is closed in the presence of water.

12. The tactical vest of claim 1, wherein said actuator is configured to which automatically inflate in the presence of water, said actuator further comprising a covering receiving the actuator for slowing the entry of water into the cover.

13. The tactical vest of claim 1, wherein one or both of the front panel and the rear panel include a ballistic-resistant material.

* * * * *